US009003946B2

(12) United States Patent
Daley et al.

(10) Patent No.: US 9,003,946 B2
(45) Date of Patent: Apr. 14, 2015

(54) ADVANCEMENT TO THE EFFECTIVENESS OF BODY ARMOR

(76) Inventors: Kevin T. Daley, Brooksville, FL (US); Joseph A. Daley, Jr., Hobe Sound, FL (US); Joseph A. Daley, III, Jupiter, FL (US)

( * ) Notice: Subject to any disclaimer, the term of this patent is extended or adjusted under 35 U.S.C. 154(b) by 145 days.

(21) Appl. No.: 13/554,909

(22) Filed: Jul. 20, 2012

(65) Prior Publication Data

US 2014/0060301 A1 Mar. 6, 2014

(51) Int. Cl.
*F41H 5/08* (2006.01)
*F41H 5/04* (2006.01)

(52) U.S. Cl.
CPC ..... *F41H 5/0464* (2013.01); *F41H 5/0471* (2013.01); *F41H 5/0428* (2013.01)

(58) Field of Classification Search
USPC ..... 89/36.05, 36.02, 36.07, 36.04; 2/2.5
See application file for complete search history.

(56) References Cited

U.S. PATENT DOCUMENTS

| | | | | |
|---|---|---|---|---|
| 5,362,527 | A * | 11/1994 | Harpell et al. | 428/33 |
| 6,962,739 | B1 * | 11/2005 | Kim et al. | 428/47 |
| 8,065,947 | B2 * | 11/2011 | Park et al. | 89/36.02 |
| 8,069,768 | B2 * | 12/2011 | Neal et al. | 89/36.01 |
| 8,365,312 | B2 * | 2/2013 | Herring | 2/2.5 |

* cited by examiner

*Primary Examiner* — J. Woodrow Eldred
(74) *Attorney, Agent, or Firm* — Edward P. Dutkiewicz

(57) ABSTRACT

An improvement to prior art of hard armor inserts that comprise a ceramic strike face and a debris collection layer that adds a diffuser layer that is attached to the debris collection layer through a plurality of flat faced pedestals to provide the useful a utility of protection from bullets.

2 Claims, 6 Drawing Sheets

ADVANCEMENT TO THE EFFECTIVENESS OF BODY ARMOR

FEDERALLY SPONSORED RESEARCH

Not Applicable

SEQUENCE LISTING OR PROGRAM

Not Applicable

FIELD OF THE INVENTION

The present invention relates generally to an improvement to hard body armor inserts for the protection of personnel from bullets

BACKGROUND OF THE INVENTION

A person of ordinary skill in the art knows there is a wide variety of body armor apparatus which are tailored to address an ever increasing number of threats from various weapons and caliber of projectiles. This invention is tailored to address hard armor inserts that offer protection from bullets. A person of ordinary skill in the art would also recognize the U.S. Department of Justice is the government entity responsible for establishing testing criteria for a full array of body armor types that offer protection ranging from needle injections to stabbings to small caliber bullets and for hard armor inserts that provide protection from bullets and armor piercing rifle rounds which are defined by the U.S. Department of Justice in the published standard titled "Ballistic Resistance of Body Armor NIJ Standard-0101.06" dated July 2008, where this invention addresses the type of body armor described in the NIJ standard as stand-alone hard armor inserts that are inserted into components described in the NIJ Standard as armor carriers which are garments that secure the armor to the user and the standard describes the acceptance testing procedures that this invention apparatus must pass including a test that allows for only a certain amount of backface signature which is the maximum allowable backface signature that may be produced which is the greatest extent of indentation in the backing material caused by the non-perforation impact on the armor.

The prior art of hard armor inserts with ceramic strike faces and debris collection layers are capable of capturing the bullet fragments and stopping fragments from perforating through the armor and entering into a person's body however there has been considerable research regarding hard armor inserts aimed to minimize the risk of bodily damage from the energy generated from projectile impact causing blunt force trauma to nearby organs, nerves, circulatory vessels and skeletal structures which to some extent is addressed by the NIJ standard limiting the allowable back face signature which also addresses to some extent a phenomena described in the literature as hydrostatic shock where sometime fatal injuries are incurred such as brain damage and hemorrhages where the projectile impacted body armor located remote from the points of injury such as to the abdomen or a limb.

The body armor industry is on a continuous quest to protect our soldiers, police and security personnel where protection goes beyond just stopping the bullet and containing the bullet fragments but to reduce injuries caused by the energy generated upon projectile impact.

At least in view of the above, it would be desirable to improve upon the prior art of protective body armor inserts by adding a feature that offers further protection to personnel from bullets. It would also be desirable to provide novel methods for manufacturing such protective armor

SUMMARY OF THE INVENTION

An object of the invention an improvement to the prior art of hard armor inserts comprised of a projectile fragmenting ceramic strike face and a debris collection layer that collects the fragments and adds a diffuser layer that is attached to the debris collection layer through a plurality of pedestals to provide protection from bullets.

PRIOR ART LITERATURE

U.S. Pat. No. 3,509,833 (Cook) discloses armor plate in which a force-absorbing base is composed of a plurality of resin-impregnated layers of glass fabric, the glass fabric being woven in a defined manner, and facing layer of alumina ceramic tiles sealed to the base with a flexible adhesive layer.

U.S. Pat. No. 3,516,898 (Cook) discloses armor plate in which a force-absorbing base is composed of a plurality of resin-impregnated layers of glass fabric, the glass fabric being laminated to a facing layer of alumina ceramic, boron carbide ceramic or silicon carbide ceramic tiles sealed to the base with a flexible adhesive layer.

U.S. Pat. No. 3,559,210 (Hansen) discloses ceramic body armor plate having a facing of hard ceramic such as boron carbide and layers of glass fabric bonded with resin that delaminates on impact.

U.S. Pat. No. 5,469,773 (Tarpinian) discloses light weight ceramic body armor plate consisting of a composite having hard frangible facing of refractory oxide and aluminum oxide bonded to a reinforced plastic backup such as laminated fiber glass.

U.S. Pat. No. 5,362,527 Harpell et al. which describes armor of one or more composite layers with planer bodies which are shown to be ether interlaced, adjacent to each other or stacked overlapping to minimize voids to thwart penetration of knives and/or bullets and which planar bodies are loosely sandwiched between layers to enable flexibility of as much as 4 inches.

U.S. Pat. No. 6,962,739 Kim et al. which describes a puncture resistant garment fabric that is flexible, bendable twistable with wire mesh embedded plates affixed.

U.S. Pat. No. 8,065,947 Park et al. which describes a hard armor composite which includes a rigid facing with a backing consisting of a plurality of overlaying layers of high performance ballistic fibers.

U.S. Pat. No. 8,069,768 Neal et al. which describes a panel for body armor comprising of overlaid layers consisting of a plurality of discrete ceramic tiles or disks which overlap adjacent tiles or disks to eliminate any voids that would allow for penetration and which is used in conjunction with a soft body armor backing.

U.S. Pat. No. 8,365,312 Herring, Steven Jay, which describes a form fitting vest for carrying armor plates and ballistic panels.

Though each of these inventions are either forms of body armor that prevent object penetration or a means of carrying body armor none of these inventions have the feature for hard body armor inserts comprising at ceramic strike face layer and a debris collection layer and diffuser layer that is attached to the debris collection layer through a plurality of flat faced pedestals.

One patent referenced above, U.S. Pat. No. 5,362,527 Harpell shows planer bodies which are shown to be ether interlaced, adjoining, adjacent or stacked overlapping to thwart penetration of knives and/or bullets which are loosely sandwiched between, but not attached to, overlapping layers to enable flexibility of as much as 4 inches and yet still stop penetration. This is as opposed to this new invention that applies to hard armor inserts that requires all of the layers to be solidly attached together to allow little flexibility to enable achievement of the maximum allowable test standards for backface signature. It should also be noted that Harpell's invention differs from this new invention where the pedestals that separate the diffusion layer from the debris collection layer in this new invention are widely spaced from each other and not interlaced, not adjoining, not adjacent and not stacked upon each other as they are positioned to maximize voids between the debris collection layer.

Other patents referenced above U.S. Pat. No. 3,509,833 (Cook), U.S. Pat. No. 3,516,898 (Cook), U.S. Pat. No. 3,559,210 (Hansen) and U.S. Pat. No. 5,469,773 (Tarpinian) are all examples of prior art hard armor inserts with ceramic strike face and debris collection layers which capture all of the projectile fragments and these provide examples for this invention of armor apparatus to which this invention adds a diffuser layer that is attached to the debris collection layer through a plurality of flat topped pedestals.

The foregoing needs are met by certain embodiments of the present invention where this invention adds to the prior art of by including a diffuser layer made of resin impregnated fibers to the backside of this prior art which is separated from the debris collection layer by flat faced pedestals made of molded resin impregnated fibers to enables the apparatus to satisfy back face signature acceptance test requirements for hard armor inserts.

In this respect, before explaining at least one embodiment of the invention in detail, it is to be understood that the invention is not limited in its application, to the details of construction, to the number of layers or to the arrangements of the components set forth in the following description or illustrated in the drawings. The invention is capable of embodiments and materials in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the concept upon which this disclosure is based may readily be utilized as a basis for other structures, methods and systems for carrying out the several purposes of the present invention. Any dimensions and manufacturing methodology provided herein are for illustration purposes only and are scalable can be modified as appropriate for the actual application. It is important, therefore, that the claims be regarded as including such equivalent constructions insofar as they do not depart from the spirit and scope of the present invention.

Figure 4:
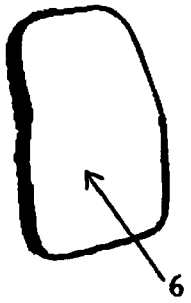

FIG. 4 [New Drawing] shows perimeter and planer contour geometries and sizes to which this invention conforms.

Figure 5:
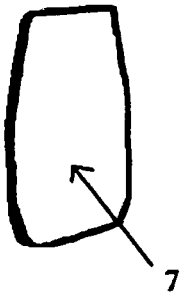

FIG. 5 [New Drawing] shows perimeter and planer contour geometries and sizes to which this invention conforms.

Figure 6:
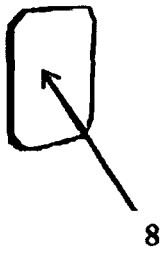

FIG. 6 [New Drawing] shows perimeter and planer contour geometries and sizes to which this invention conforms.

Figure 7:
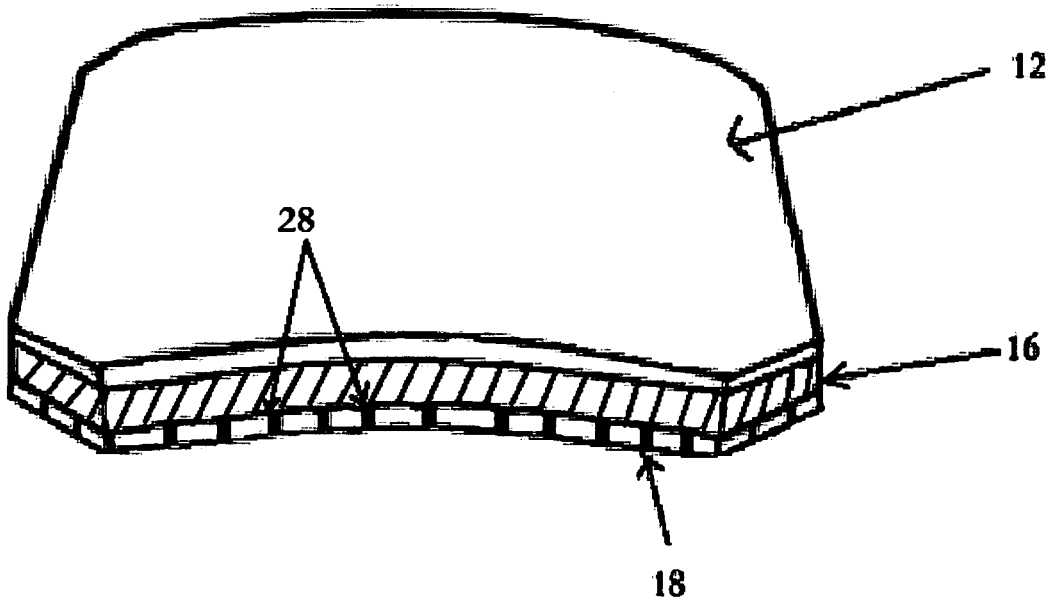

FIG. 7 [New Drawing] shows a isometric view of the invention

Figure 8:
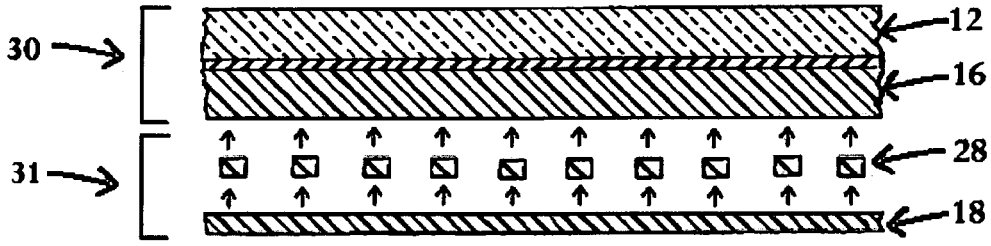

FIG. 8 [New Drawing] shows an exploded view of the invention details to be attached to the prior art.

Figure 9:
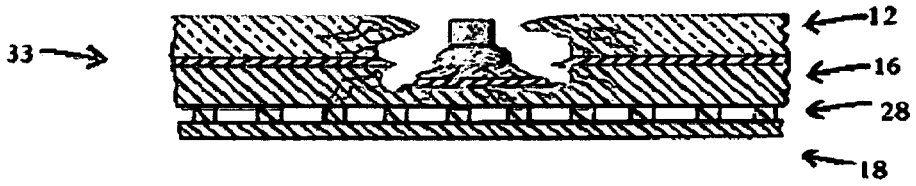

FIG. 9 [New Drawing] shows a fully attached view after impact of the features of the diffusion layer of this invention being separated by pedestals and attached to Cook's prior art inventions previously cited.

Figure 10:
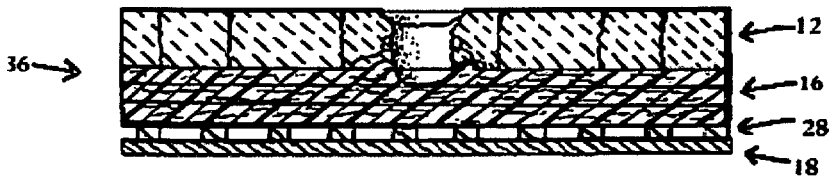

FIG. 10 [New Drawing] shows a fully attached view after impact of the features of the diffusion layer of this invention being separated by pedestals and attached to Tarpinion's prior art invention previously cited.

DETAILED DESCRIPTION

The invention will now be described with reference to the drawing figures, in which like reference numerals refer to like parts throughout. Certain embodiments of the present invention include protective armor that may be used as a defense against bullets according to the present discussion.

Figure 1:
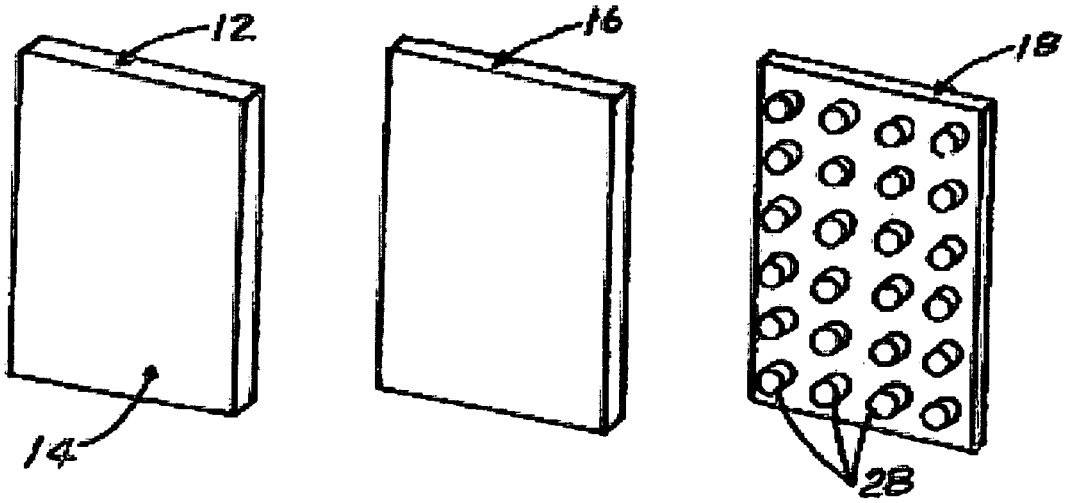
FIG. 1 is a perspective, exploded view of three components of one embodiment of this protective armor apparatus showing a diffuser layer with flat faced pedestals attached to a debris collection layer which is attached to a ceramic strike face.
Figure 2:
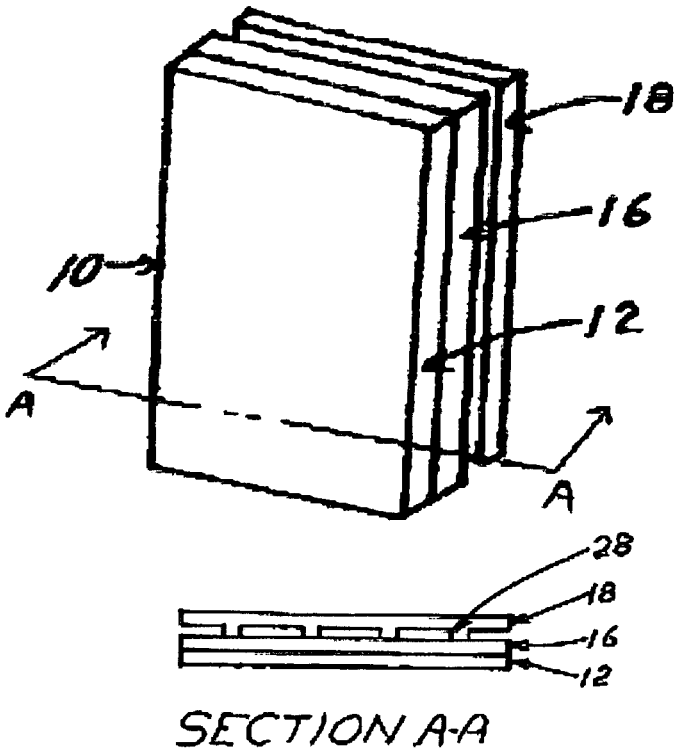
FIG. 2 is a perspective, assembled view of three components of one embodiment of protective armor showing a diffuser layer with flat faced pedestals attached to the prior art debris collection layer which is attached to a ceramic strike face and a cross section view thereof.

FIG. 1 is a perspective of an exploded view comprising a continuous, solid diffuser layer 18 with continuous, solid flat faced pedestals 28 which, in this embodiment, each measures approximately one quarter inch tall and one half inch wide that are spaced roughly three quarter of an inch apart over the entire outer surface area of the diffuser layer to enable bonding to a debris collection layer 16 which is attached to hard ceramic impact-facing strike face 14. The body armor comprises three layers, a diffuser layer, a debris collection layer, and a strike face layer. The diffuser layer has an inner surface which is oriented toward a wearer and an outer surface which is oriented away from a wearer. The outer surface having a plurality of solid flat faced pedestals. The diffuser layer and the flat face pedestals are continuous, as shown in FIG. 2, Section A-A. The diffusion layer and pedestals may be fabricated of one of the group of materials which includes metal matrix composites and resin impregnated fibers. The debris collection layer is a continuous layer, as shown in FIG. 2, Section A-A. The debris collection layer has an outer surface and an inner surface, the inner surface which is oriented toward a wearer and the outer surface which is oriented away from a wearer. The inner surface of the debris collection layer being bonded to the pedestals of the diffuser layer. The strike face layer has an outer surface and an inner surface, with the inner surface of the strike face layer being attached to the outer surface of the debris collection layer. The strike face layer is fabricated of a hard ceramic material.

FIG. 2 is an assembled view of FIG. 1-10, comprising the diffuser layer 18 with solid continuous flat faced pedestals 28, which is attached to the debris collection layer 16, which is attached to the hard ceramic strike face layer 12 serving as the projectile strike face and provides a cross section view of the same assembled apparatus.

Figure 3:
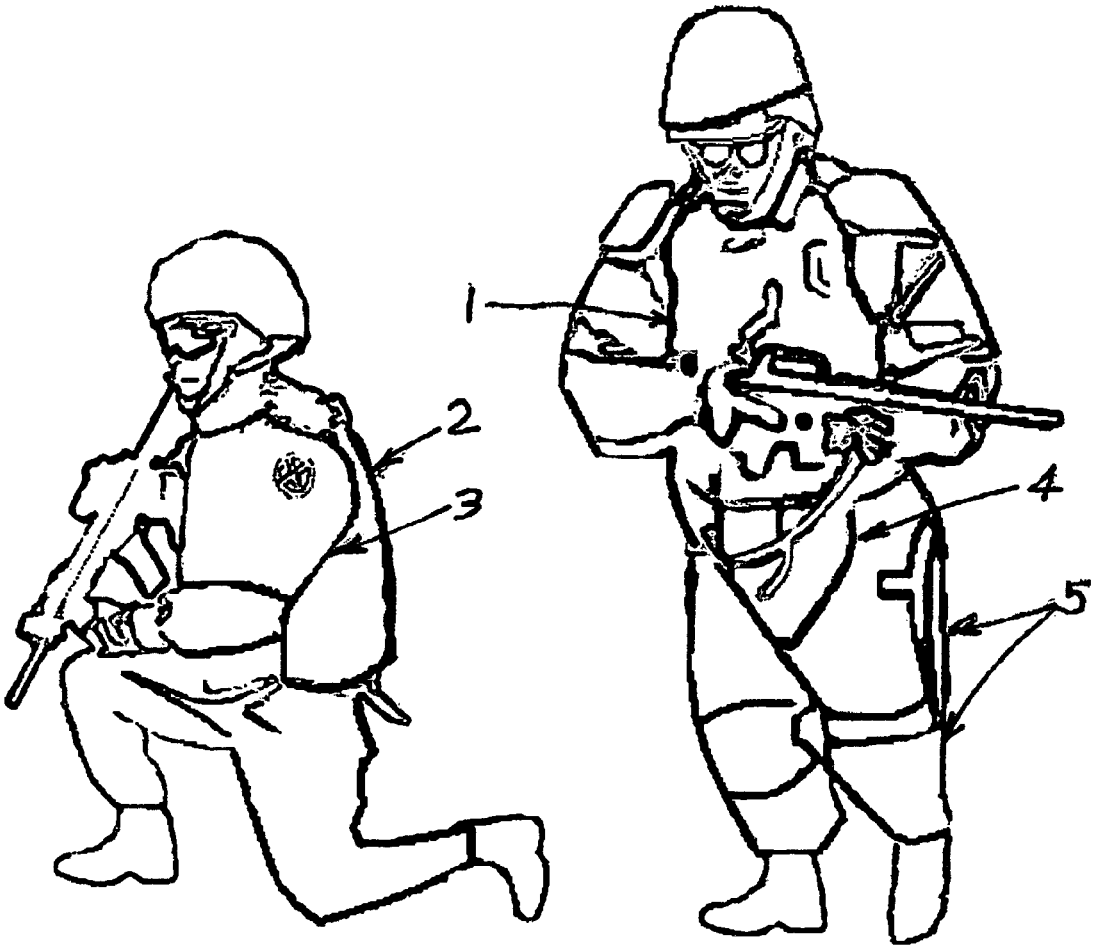
FIG. 3 illustrates possible applications of this body armor apparatus pointing to locations on soldiers where this body armor apparatus can be utilized such as the (1) chest, (2) back, (3) sides, (4) groin and (5) legs are all areas potentially protected by this body armor.

FIG. 3 illustrates possible applications of this body armor apparatus pointing to locations on soldiers where this apparatus of hard armor inserts can be inserted into armor plate carriers such as the chest 1, back 2, side 3, groin 4 and leg areas 5.

FIG. 4 [New Drawing] shows perimeter and planer contour geometries to which this invention complys such as curved surface that tapers from top to bottom 6

FIG. 5 [New Drawing] perimeter and planer contour geometries to which this invention complies where it is rounded at the bottom and asymmetrically square at the top 7.

FIG. 6 [New Drawing] shows perimeter and planer contour geometries to which this invention complies such as or smaller overall size and symmetrically rectangular 8.

FIG. 7 [New Drawing] shows a three dimensional view of the invention is an assembled comprising a diffuser layer 18 with flat faced pedestals 28 which are attached to a debris collection layer 16 which is attached to the hard ceramic strike face 12 as the assembled apparatus.

FIG. 8 [New Drawing] shows and exploded view 32 of the features of the diffusion layer of this invention 31 being separated by pedestals and attached hard armor inserts 30 comprising an diffuser layer 18 which will be attached to solid flat faced pedestals 28 which will be attached to a debris collection layer 16 which is attached to the hard ceramic strike face 12.

FIG. 9 [New Drawing] shows the composite view with features attached together after impact of a projectile where the features of the diffusion layer of this invention being attached through pedestals and attached to debris collection layer of prior art such as Cook U.S. Pat. No. 3,509,833 33 that comprises an diffuser layer 18 which is attached to solid flat faced pedestals 28 which are attached to a debris collection layer 16 which is attached to the hard ceramic, strike face 12.

FIG. 10 [New Drawing] shows the composite view with features attached together after impact of a projectile where the features of the diffusion layer of this invention being attached through pedestals and attached to prior art such as (Tarpinian) U.S. Pat. No. 5,469,773 36 that also comprises an diffuser layer 18 which attached to solid flat topped pedestals 28 which are attached to a debris collection layer 16 which is attached to the hard ceramic, strike face 12.

What is claimed is:

1. An apparatus comprising:

a continuous, solid diffuser layer fabricated one of the group of materials which includes metal matrix composites and resin impregnated fibers, the diffuser layer having an inner surface and an outer surface, the diffuser layer having and being continuous with a plurality of pedestals, the pedestals each being separate, the pedestals being continuous with the diffuser layer, the pedestals having a solid flat faced configuration, each pedestal measuring approximately one quarter inch tall and one half inch wide, each of the pedestals being spaced about three quarter of an inch apart over the entire outer surface area of the diffuser layer;

a debris collection layer being a continuous layer, the debris collection layer having an outer surface and an inner surface, the inner surface of the debris collection layer being oriented toward a wearer and the outer surface which is oriented away from the wearer, the inner surface of the debris collection layer being bonded to the pedestals of the diffuser layer and forming voides between the debris collection layer and the diffuser layer; and a ceramic strike face layer having an outer surface and an inner surface, with the inner surface of the strike face layer being attached to the outer surface of the debris collection layer, the strike face layer being fabricated of a hard ceramic material providing the useful utility of protection from bullets.

2. The apparatus described in claim 1 with the strike face layer having a protective tear resistant polyester film on the outer surface to reduce ceramic fragment dispersion after impact of a projectile.

* * * * *